US009697810B2

(12) United States Patent
Momose et al.

(10) Patent No.: US 9,697,810 B2
(45) Date of Patent: Jul. 4, 2017

(54) STRAINER FOR A SNARE DRUM

(71) Applicant: Pearl Musical Instrument Co., Chiba (JP)

(72) Inventors: Katsuhiro Momose, Chiba (JP); Yuichi Sato, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 14/939,078

(22) Filed: Nov. 12, 2015

(65) Prior Publication Data

US 2016/0140939 A1 May 19, 2016

Related U.S. Application Data

(60) Provisional application No. 62/079,374, filed on Nov. 13, 2014.

(51) Int. Cl.
*G10D 13/02* (2006.01)

(52) U.S. Cl.
CPC ..... *G10D 13/025* (2013.01)

(58) Field of Classification Search
USPC ..... 84/415
See application file for complete search history.

(56) References Cited

U.S. PATENT DOCUMENTS 1,446,327 A 2/1923 Baldwin et al.
1,828,083 A 10/1931 Strupe
2,096,209 A 10/1937 Strupe
3,113,481 A 12/1963 Thompson
4,138,920 A 2/1979 Meador
4,520,709 A 6/1985 Kester, Jr.
5,107,742 A * 4/1992 Cummings ..... G10D 13/025 84/415
5,557,053 A 9/1996 Nickel
5,684,257 A * 11/1997 Yanagisawa ..... G10D 13/025 84/415
6,700,046 B2 3/2004 Cherbettchian
7,223,910 B2 5/2007 Shimada
7,262,355 B2 8/2007 Hagiwara et al.
7,312,389 B2 * 12/2007 Okamoto ..... G10D 13/025 84/411 R
7,365,256 B2 4/2008 Takegawa
7,462,771 B1 12/2008 McCraw
(Continued)

*Primary Examiner* — Christopher Uhlir
(74) *Attorney, Agent, or Firm* — Manelli Selter PLLC; Edward J. Stemberger

(57) ABSTRACT

A strainer is provided for a snare drum having a bottom drumhead. The strainer includes a snare assembly including a snare carrier and a plurality of snares coupled therewith. A throw-side component includes a bracket member releasably mounted to the snare drum and a slide member moveable relative to the bracket member and engaging the snare carrier. The slide member includes a slider handle fixed thereto and a locking toggle such that when the strainer is coupled to the snare drum, manual movement of the slider handle causes the snares to move toward the bottom drumhead, with the locking toggle being constructed and arranged to be 1) moved to a first, locking position engaging the bracket member so as to lock the slide member to the bracket member, and 2) moved to a second, release position releasing the slide member from engagement with the bracket member.

21 Claims, 12 Drawing Sheets

(56) References Cited

U.S. PATENT DOCUMENTS

| | | | | |
|---|---|---|---|---|
| 7,700,864 | B1 | 4/2010 | Sikra | |
| 8,193,435 | B1 | 6/2012 | Lombardi et al. | |
| 8,426,711 | B2 | 4/2013 | Abe | |
| 2007/0079686 | A1* | 4/2007 | Hsieh | G10D 13/025 84/415 |

* cited by examiner

STRAINER FOR A SNARE DRUM

This Application claims the benefit for priority purposes from U.S. Provisional Application No. 62/079,374, filed on Nov. 13, 2014, the content of which is hereby incorporated by reference into this specification.

FIELD

The present invention relates to snare drums in general and, more particularly, to a strainer for use with a snare drum, where the strainer includes a throw-off mechanism.

BACKGROUND

Snare drums typically include a plurality of wires, or snares, which contact a bottom drumhead or drumskin of the snare drum so that the snares are vibrated by the vibration of the bottom drumhead when the snare drum is played. A strainer is typically used to tension the snares in order to change the tone produced by the drum by changing the position of the snares so that they are either in contact or not in contact with the drumhead. Snare tension may also be fine-tuned or finely adjusted by a tension knob which is rotated to finely tune the tension in the snare to change the tone produced by the drum.

Conventional strainers for snares use a lever directly connected to a piston, wherein the lever pivots about an axis generally perpendicular to the piston so that, when the lever is pivoted from one position to another, the piston drops and the tension in the snares is released so that the snares are no longer in contact with the drumhead. Some of these pivoting levers for strainers can only be operated so that the snares are either in contact with the drumhead (snares-on mode), or not in contact with the drumhead (snares-off mode), and are not adjustable to different tensions in between those extremes. Further, the strainer can include a throw-off mechanism configured to tension or quickly release the snares. Other prior art systems permit intermediate adjustment of the snare tension between the snare-on and snare-off modes using the strainer.

However, strainer levers of the prior art systems may accidentally become dislodged because they do not have a positive lock mechanism. Therefore, the levers can accidentally vibrate loose and disengage to the off position during vigorous play.

Therefore, there is need for a novel, simple and effective throw-off mechanism that a drummer may use to quickly tension and/or release snares, such as metal wires, that are used adjacent the bottom drumhead to produce certain distinctive acoustic effects, upon beating a drum.

SUMMARY

The present embodiment is directed to a strainer for a snare drum having a bottom drumhead. The strainer includes a snare assembly including at least one snare carrier and a plurality of snares coupled with the at least one snare carrier at one end thereof, and constructed and arranged to be coupled to the snare drum at another end thereof. A throw-side component includes a bracket member constructed and arranged to be releasably mounted to the snare drum, and a slide member manually moveable relative to the bracket member and engaging the at least one snare carrier. The slide member includes at least one slider handle fixed thereto, and a locking toggle such that when the strainer is coupled to the snare drum with the snares generally adjacent to the bottom drumhead, manual movement of the slide member via the slider handle causes the snares to move toward the bottom drumhead, with the locking toggle being constructed and arranged to be 1) moved to a first, locking position engaging the bracket member so as to lock the slide member to the bracket member, and 2) moved to a second, release position releasing the slide member from engagement with the bracket member.

Of course, the invention should not be limited to the specific structure shown in the drawings or described herein. The structural and functional benefits of the present invention will be apparent to those of skill in the art when viewed in light of the following description and the accompanying drawings, which are not intended to limit the scope of the invention.

BRIEF DESCRIPTION OF THE DRAWING(S)

The accompanying drawings are incorporated in and constitute a part of the specification. The drawings, together with the general description given above and the detailed description of the exemplary embodiments and methods given below, serve to explain the principles of the invention. The objects and advantages of the invention will become apparent from a study of the following specification when viewed in light of the accompanying drawings, in which like elements are given the same or analogous reference numerals and wherein.

DETAILED DESCRIPTION OF EXEMPLARY EMBODIMENT

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods.

Figure 1:
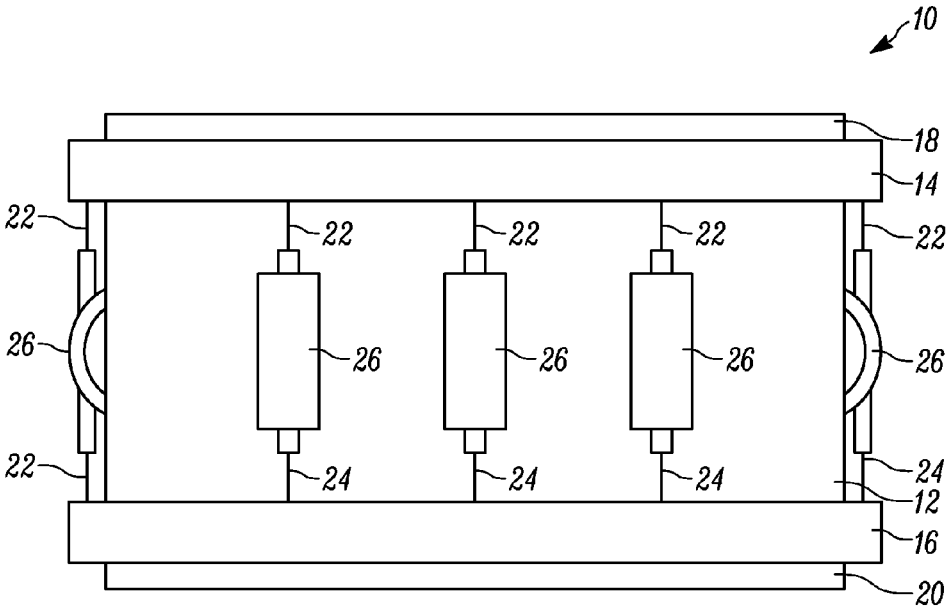
FIG. 1 is a side view of a drum according to an exemplary embodiment shown without a strainer attached thereto.
Figure 2:
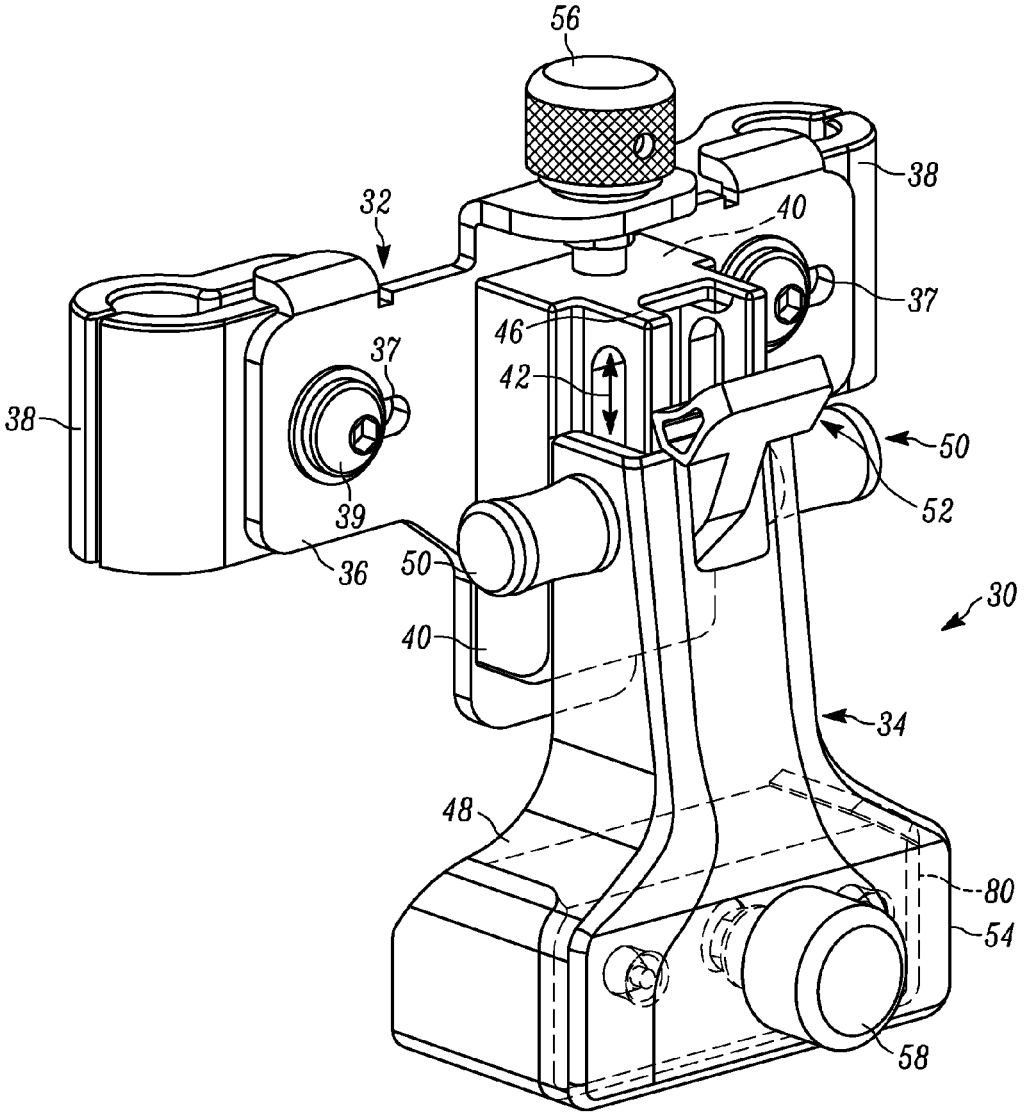
FIG. 2 is a perspective view of a throw-side component of a strainer according to an exemplary embodiment shown in a snare-off position.
Figure 3A:
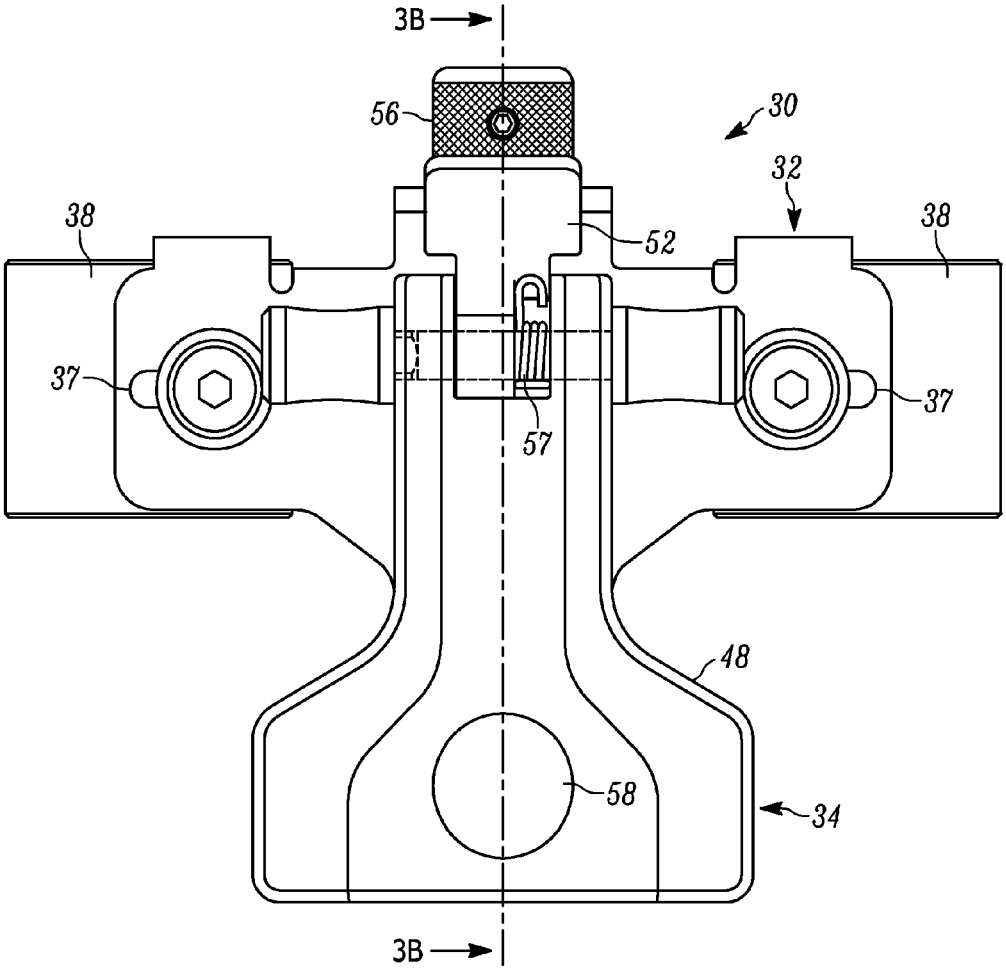
FIG. 3A is a front view of the throw-side component of the strainer according to the exemplary embodiment shown in a snare-on position.
Figure 3B:
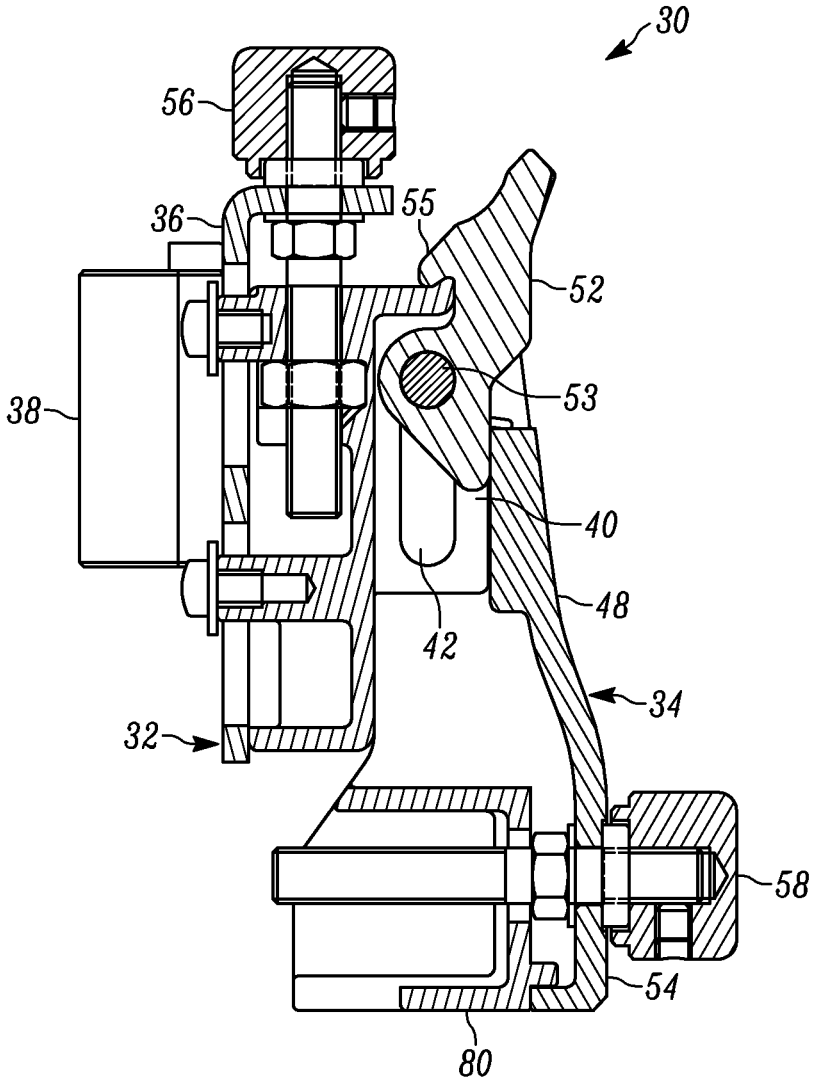
FIG. 3B is a cross sectional view of the throw-side component of the strainer taken along section line X-X in FIG. 3A.
Figure 4A:
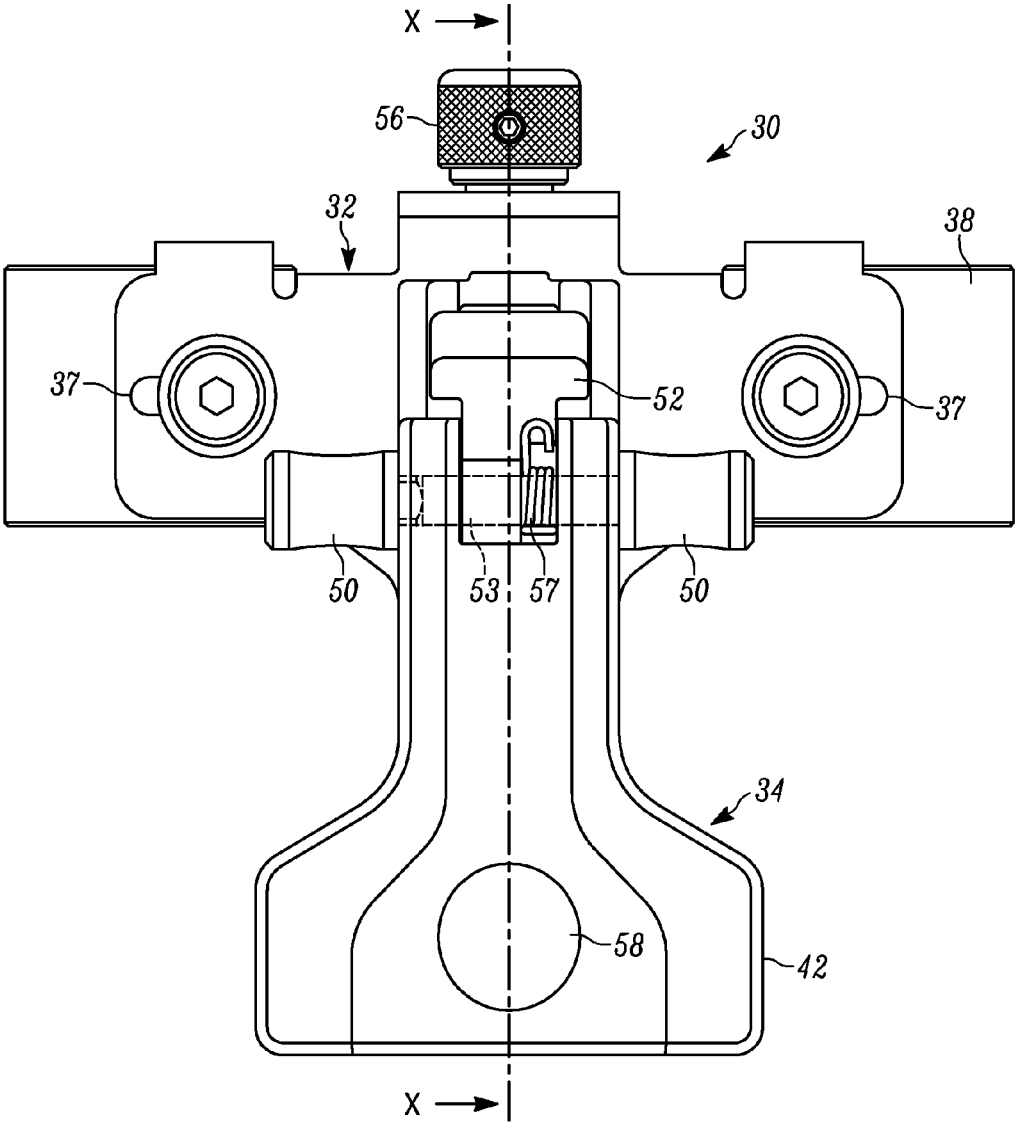
FIG. 4A is a front view of the throw-side component of the strainer according to the exemplary embodiment shown in the snare-off position.
Figure 4B:
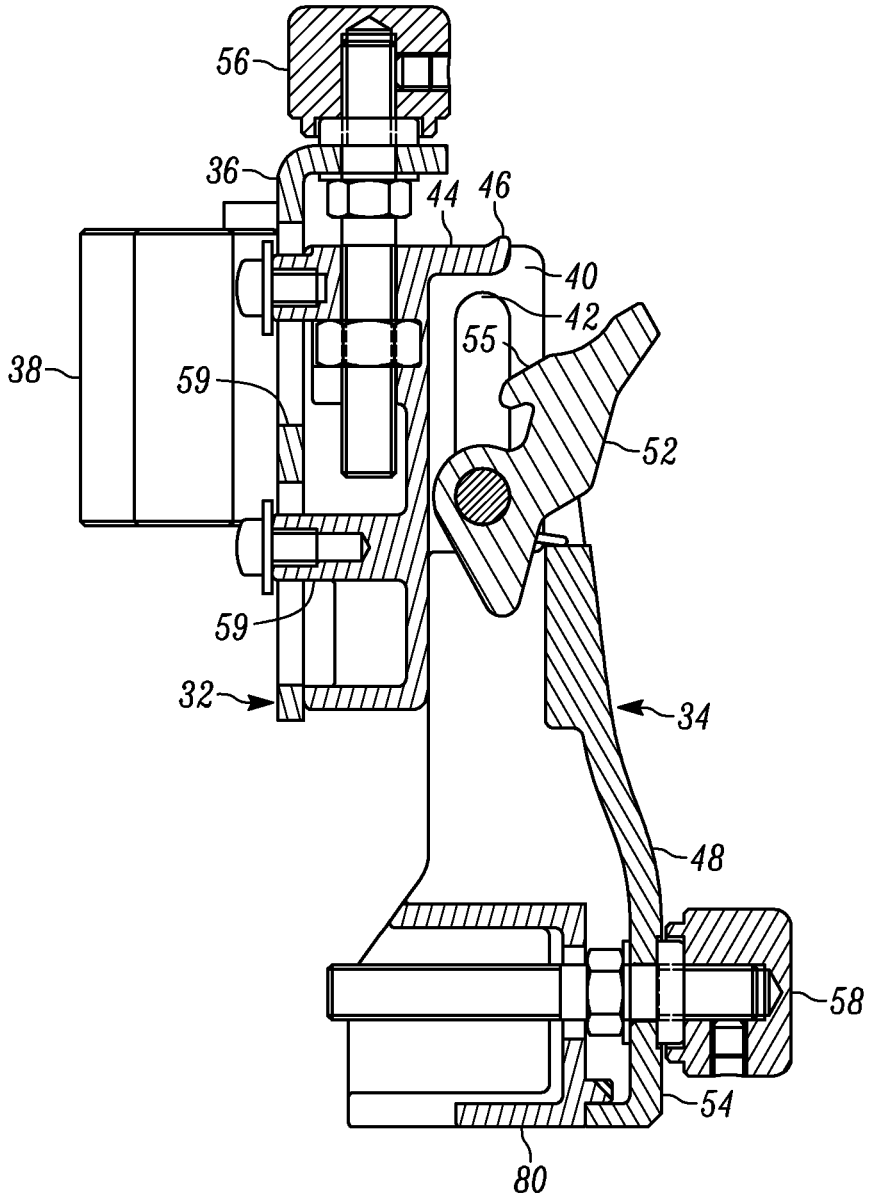
FIG. 4B is a cross sectional view of the throw-side component of the strainer taken along section line X-X in FIG. 4A.

FIG. 1 illustrates a snare drum 10 according to an exemplary embodiment of the present disclosure shown without a strainer attached. The drum 10 comprises a drum shell 12, an upper hoop 14, a lower hoop 16, an upper drumhead 18, a lower drumhead 20, upper tensioning rods 22, lower tensioning rods 24, and tension posts 26 interconnecting the upper and lower tensioning rods 22, 24.

Figure 5:
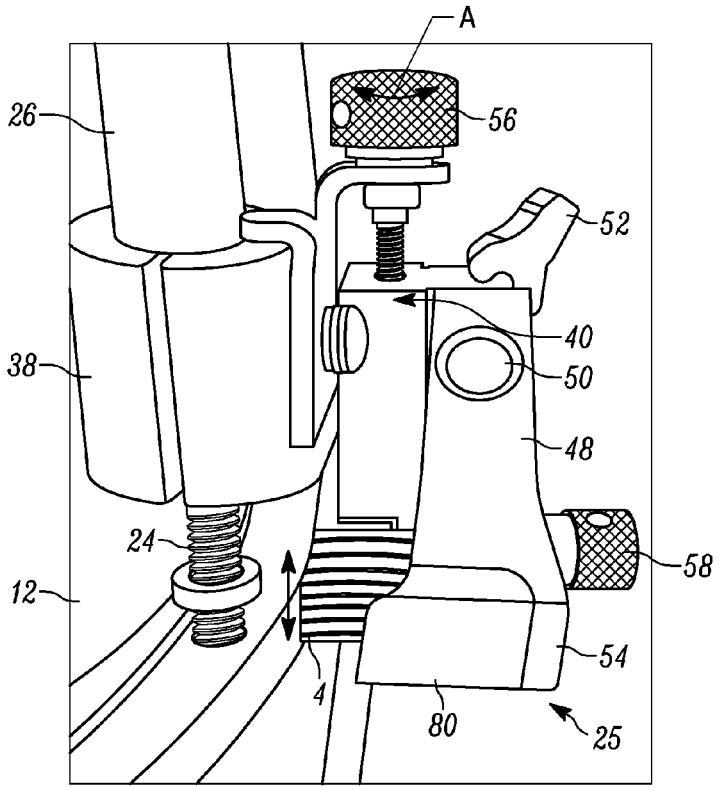
FIG. 5 is a side view of the throw-side component according to the exemplary embodiment shown in the snare-on position.
Figure 6:
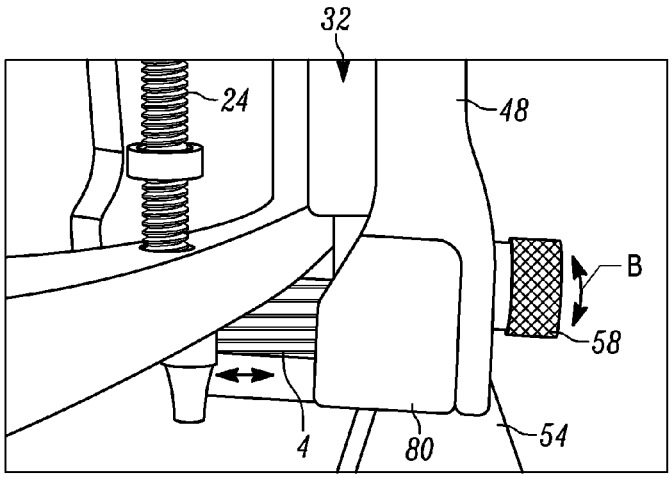
FIG. 6 is an enlarged side view of the throw-side component of the strianer according to the exemplary embodiment.
Figure 7:
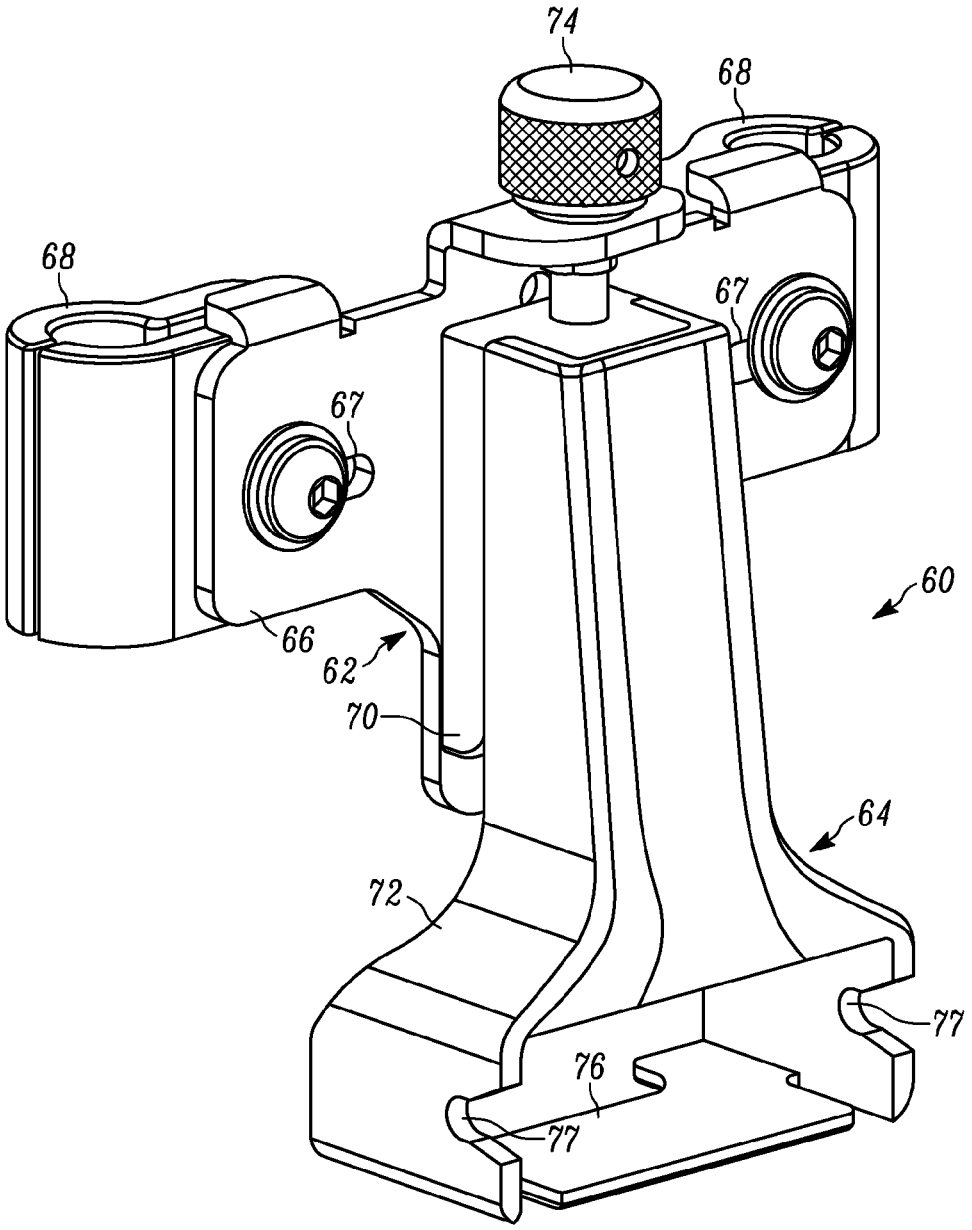
FIG. 7 is a perspective view of a butt-side component of the strainer according to an exemplary embodiment.
Figure 8A:
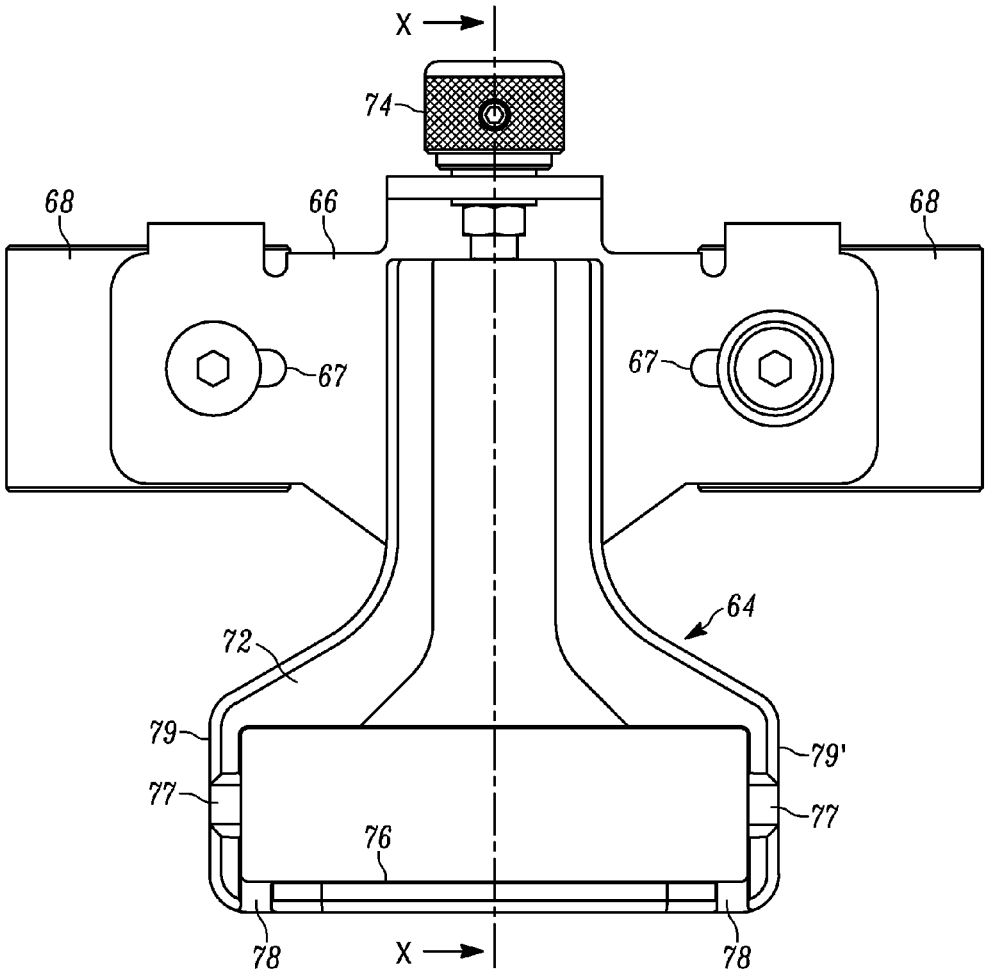
FIG. 8A is a front view of the butt-side component of the strainer according to the exemplary embodiment.
Figure 8B:
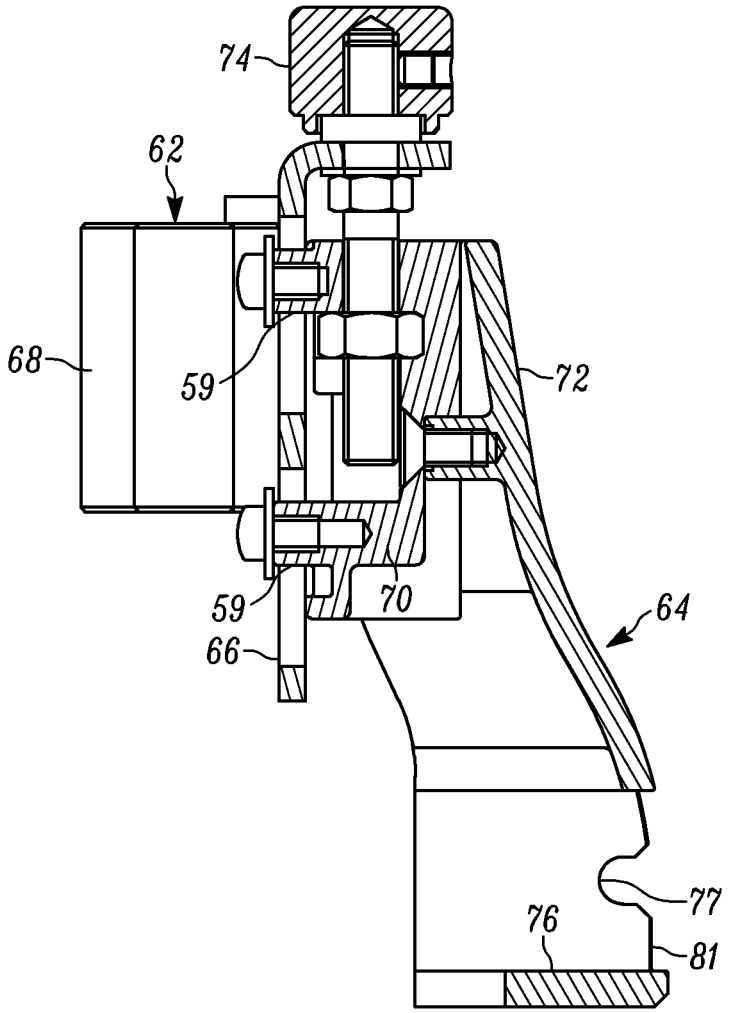
FIG. 8B is a cross sectional view of the butt-side component of the strainer taken along section line X-X in FIG. 8A.
Figure 9:
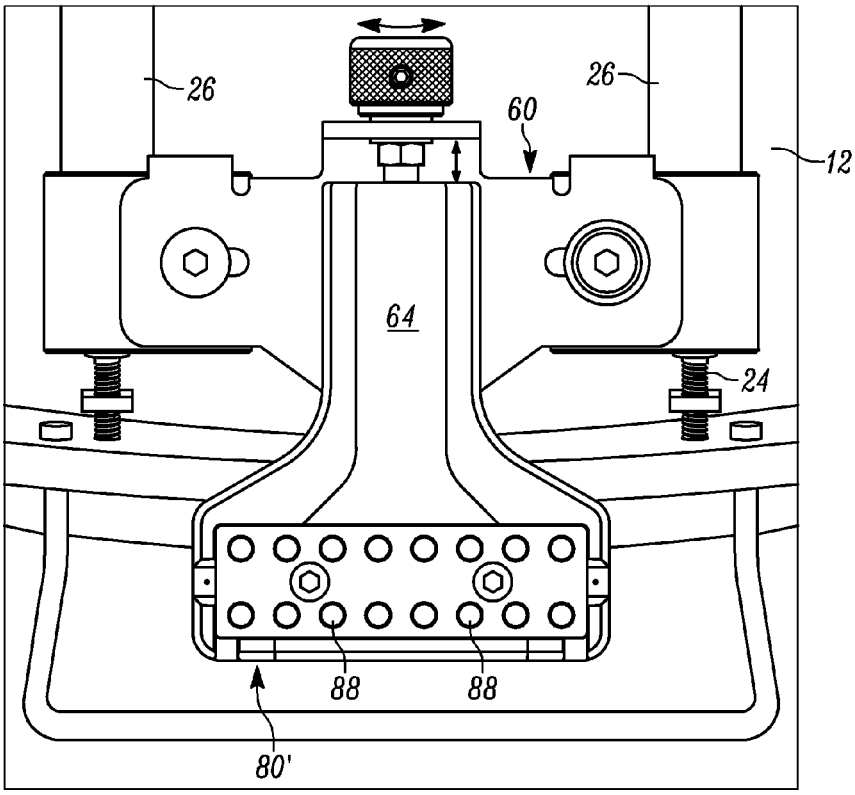
FIG. 9 is a front view of the butt-side component with a second snare carrier of the strainer according to the exemplary embodiment.
Figure 10:
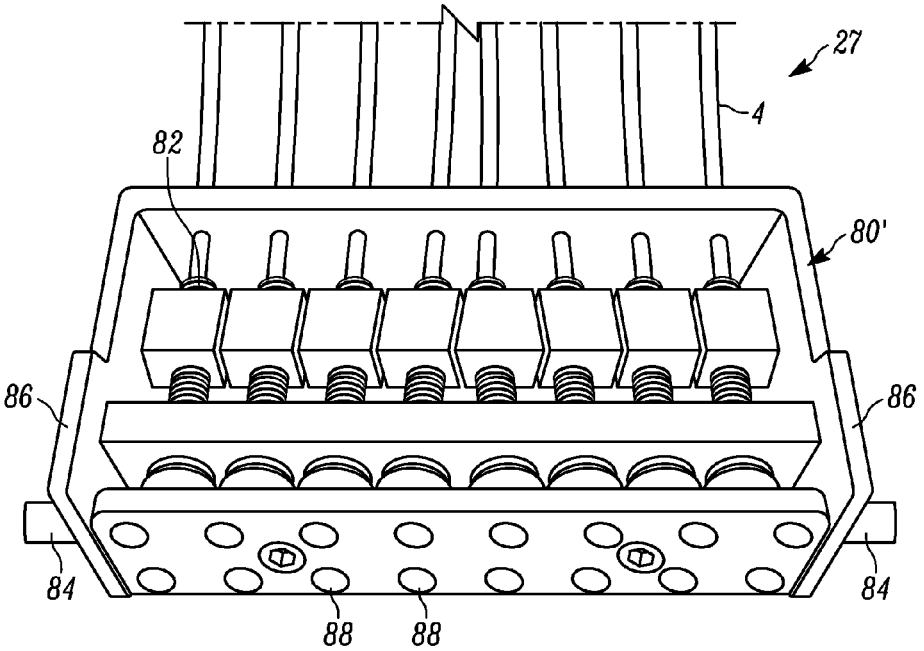
FIG. 10 is a perspective view of an individual snare wire tension adjustment mechanism of the strainer according to an exemplary embodiment.
Figure 11A:
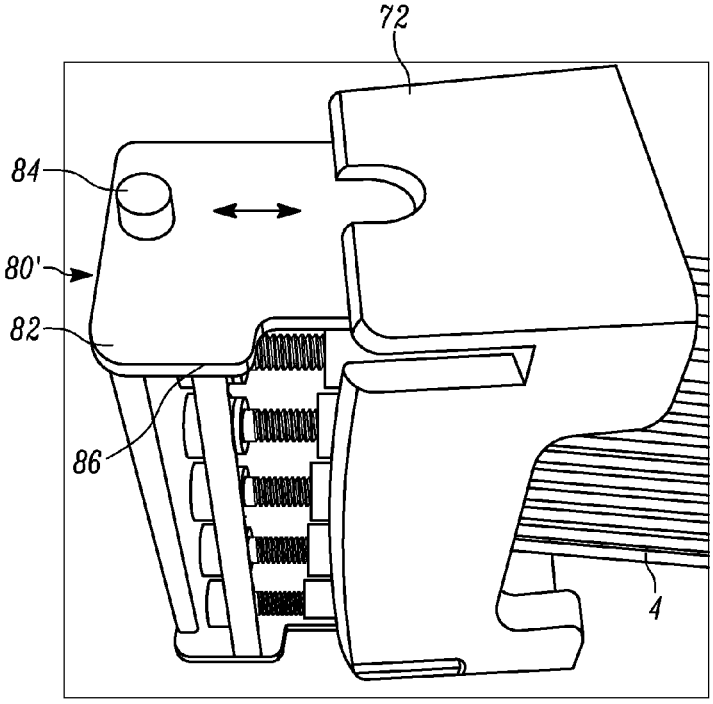
FIG. 11A is a perspective view of the second snare carrier disengaged from the butt-side component.
Figure 11B:
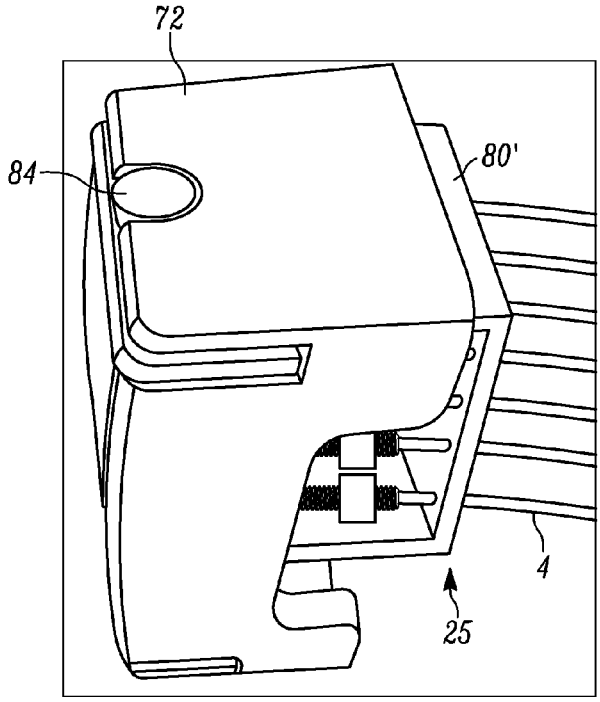
FIG. 11B is a perspective view of the second snare carrier engaged with the butt-side component.

A strainer, shown generally indicated at 25 in FIGS. 5 and 11B, includes a first side (or throw-side) component 30 (best shown in FIGS. 2-6) and a second side (or butt-side) component 60 (best shown in FIGS. 7-11B) constructed and arranged to be mounted to the tension posts 26 (as best shown in FIGS. 7 and 9) at diametrically opposite sides of the lower hoop 16. The strainer 25 includes snares or wires 4 extending between two opposite snare carriers 80, 80' holding opposite ends of the snares 4 (see FIGS. 7, 10 and 11A). The carriers 80, 80' and the snares 4 fixed to and extending between the carriers 80 can be considered to be a snare assembly 27 of the strainer 25.

The first side component 30 includes a bracket member 32 releasably mounted to the tension posts 26, and a slide member 34 engaging the first snare carrier 80 (FIG. 5) and linearily slidable (or moveable) relative to the bracket member 32 in the vertical direction.

The bracket member 32 includes a base plate 36, one or more clamps 38 moveably (or adjustably) mounted to the base plate 36 using elongated adjustment slots 37 formed through the base plate 36, and fasteners 39. The one or more clamps 38 are configured to releasably mount the bracket member 32 to the tension posts 26 (as best shown in FIG. 5). The bracket member 32 has an adjustment member 40 defining an elongated channel 42 extending in a substantially vertical direction, and also has an upper surface 44 provided with a raised lip 46, the function of which will be explained below.

The slide member 34 includes a slider 48 having a pair of horizontally opposite slider handles 50 fixed to the slider 48. The slide member 34 further includes a locking toggle 52 pivotally mounted about a pin 53 to the slider 48. The pin 53 slides vertically in the slot 42 permitting vertical movement of the slider 48. The toggle 52 has a hook end 55 that is adapted to engage the raised lip 46 of the adjustment member 40 of the bracket member 32 as explained more fully below. The slide member 34 further includes a snare support 54 fixedly engaging the first snare carrier 80 and moveably mounted to the slider 48 for selective linear displacement relative to the slider 48.

When the locking toggle 52 is manually pivoted to a first, locking position and the hook end 55 engages the raised lip 46, the locking toggle 52 locks the slide member 34 in an "On" or snare-on position (shown in FIGS. 3A and 3B) ensuring that the slide member 34 is held in position for proper snare wire response without fail during use. A coil spring 57 biases the locking toggle 52 towards the first, locking position to maintain the locking toggle 52 in the locked position. When the locking toggle 52 is manually pivoted to a second, release position (i.e., rotated about pin 55 and against the bias of spring 57) the hook end 55 is disengaged from the raised lip 46 of the bracket member 32. The slide member 34 is manually moved downardly to the bottom of the channel 42 to an "Off" (or snare-off) position to release the snares (wires 4) from the lower drumhead 20 for service, adjustment, or musical effect. Thus, the slide member 34 with the slider handles 50 and the locking toggle 52 defines a throw-off mechanism.

In operation, the user raises the slide member 34 up using the slider handles 50 to lift throw-off mechanism into the "On" position, and then the locking toggle 52 can again lock the slide member 34 into place.

The first side component 30 further includes a vertical tension adjustment knob 56 mounted to the fixed base plate 36 of the bracket member 32 for vertical fine adjustment of the snare 4 tension, and a horizontal tension adjustment knob 58 for horizontal fine adjustment of the snare tension. Specifically, the rotational movement (see arrow A in FIG. 5) of the vertical tension adjustment knob 56 is transformed into a linear vertical movement of the adjustment member 40 relative to the base plate 36 by a tension thread/nut system engaged therewith, since the adjustment member 40 is mounted to the base plate 36 for vertical movement using a slotted connection 59. When the throw-off mechanism is "On" and locked, movement of the adjustment member 40 in turn moves the slide member 34 and thus the snare carrier 80 vertically to adjust the snares 4. In addition, rotational movement (see arrow B in FIG. 6) of the horizontal tension adjustment knob 58 is transformed into a linear horizontal movement of the snare carrier 80 relative to the slider 48 by a tension thread/nut system. In other words, the vertical tension adjustment knob 56, when turned clockwise increases snare wire pressure against the bottom drumhead 20. When turned counterclockwise it loosens the wires 4 from the bottom drumhead 20. Similarly, the horizontal tension adjustment knob 58, when turned clockwise pulls or tensions wires 4 only and when turned counterclockwise it releases tension on wires 4 by controlling movement of the snare holder 80.

The butt-side component 60 of the strainer 25 includes a bracket member 62 releasably mounted to the tension posts 26 (as best shown in FIG. 9), and a slide member 64 engaging the second snare carrier 80' (FIG. 9) and linearily moveable relative to the bracket member 62 in the vertical direction. The bracket member 62 of the butt-side component 60 includes a base plate 66, one or more clamps 68 moveably (or adjustably) mounted to the base plate 66 using elongated adjustment slots 67 formed through the base plate 66. The one or more clamps 68 are configured to releasably mount the bracket member 62 to the tension posts 26. An adjustment member 70 is linearily moveable relative to the base plate 66 in the vertical direction so as to adjust the position of the adjustment member 70 relative to the base plate 66 in the vertical direction, since the adjustment member 70 is mounted to the base plate 66 for vertical movement using a slotted connection 59.

The slide member 64 includes a slider 72 non-moveably secured (i.e., fixed) to the adjustment member 70, such as by a threaded fastener. The butt-side component 60 further includes a vertical tension adjustment knob 74 mounted to the base plate 66 of the bracket member 62 for vertical fine adjustment of the snare 4 tension. Specifically, rotational movement of the vertical tension adjustment knob 74 is transformed into a linear vertical movement of the adjustment member 70 relative to the base plate 66 by a tension thread/nut system engaged with the adjustment member 70. Thus, the adjustment member 70 moves in a direction transverse with respect to a longitudinal direction of the snares or wires 4.

A lower distal end of the slider 72 of the slide member 64 includes walls defining a hollow snare receptacle 76 for receiving the second snare carrier 80' therein. The walls 79, 79' of the slider 72 define horizontally opposite grooves 77 and two horizontally opposite channels (or slots) 78 formed adjacent to the snare receptacle 76 at a proximal end 81 of the slider 72. In turn and with reference to FIGS. 10 and 11A, 11B, the second snare carrier 80' includes a carrier casing 82 having two horizontally opposite posts 84 horizontally outwardly extending from the carrier casing 82 and two horizontally opposite guide members 86. The posts 84 of the carrier casing 82 are complementary to the grooves 77 of the slider 72, while the guide members 86 of the carrier casing 82 are complementary to the slots 78 of the slider 72. Thus, in the assembled condition, the posts 84 of the carrier casing 82 are received in and engage the grooves 77 of the slider 72, while the guide members 86 are received in and engage the slots 78 of the slider 72, as shown in FIGS. 11A and 11B. Such an arrangement allows the carrier casing 82 of the snare assembly 27 to be installed only in one direction to ensure the correct orientation thereof. Thus, the vertical tension adjustment knob 74, when turned clockwise increases snare wire pressure against the bottom drumhead 20. When turned counterclockwise it releases tension on the wires along the bottom drumhead 20.

The carrier casing 82 includes an individual snare wire (gut) tension adjustment structure (best shown in FIG. 10) including a plurality of screws 88, each coupled with an associated wire 4 for adjusting tension of only the associated wire 4. The individual wire tension adjustment structure is provided on the butt-side component 60 only.

Therefore, the strainer 25 having a new and novel snare drum throw-off mechanism according to the embodiment provides the direct actuation means by which the snares of the drum 10 are "activated" against the bottom drumhead without the assistance of a lever or cam device in the mechanism. The user pulls directly on the slide member of the throw-side component that is attached to the snare assembly itself, causing the wires to come in contact with the drumhead. This configuration eliminates all moving parts and pivot points in the mechanism operation.

The foregoing description of the exemplary embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A strainer for a snare drum having a bottom drumhead, the strainer comprising:

a snare assembly including at least one snare carrier and a plurality of snares coupled with the at least one snare carrier at one end thereof and constructed and arranged to be coupled to the snare drum at another end thereof, and a throw-side component including a bracket member constructed and arranged to be releasably mounted to the snare drum, and a slide member manually linearly moveable relative to the bracket member and engaging the at least one snare carrier;

the slide member including at least one slider handle fixed thereto so that the at least one handle moves linearly together with the slide member, and a locking toggle such that when the strainer is coupled to the snare drum with the snares generally adjacent to the bottom drumhead, movement of the slide member via manual linear movement of the at least one slider handle causes the snares to move toward the bottom drumhead, with the locking toggle being constructed and arranged to be 1) moved to a first, locking position engaging the bracket member so as to prevent the slide member from moving further thus, locking the slide member to the bracket member, and 2) moved to a second, release position releasing the slide member from engagement with the bracket member.

2. The strainer of claim 1, wherein the bracket member includes a raised lip and the locking toggle includes a hook end, the hook end being constructed and arranged to engage the raised lip to lock the slide member to the bracket member.

3. The strainer of claim 1, further comprising a spring constructed and arranged to bias the locking toggle toward the first, locking position.

4. The strainer of claim 1, wherein the bracket member has an elongated slot and the locking toggle is mounted to pivot about a pin, the pin being disposed for movement within the slot thereby permitting movement of the slide member.

5. The strainer of claim 1, wherein the bracket member includes at least one clamp constructed and arranged to engage at least one tension rod of the snare drum to mount the bracket member to the snare drum.

6. The strainer of claim 1, wherein the slide member includes a receptacle receiving the at least one snare carrier therein.

7. The strainer of claim 1, wherein the slide member includes an adjustment knob associated with the at least one snare carrier so that movement of the adjustment knob adjusts a position of the at least one carrier in a first, snare tensioning direction.

8. The strainer of claim 7, wherein the bracket member includes an adjustment member mounted for movement with respect to a fixed base plate, and further comprising a second adjustment knob associated with the adjustment member such that when the slide member is locked to the bracket member, movement of the second adjustment knob adjusts a position of the adjustment member and thus a position of the at least one snare carrier in a direction transverse to the first direction.

9. The strainer of claim 1, wherein the snare assembly includes first and second snare carriers, with the plurality of snares being coupled with each snare carrier and extending there-between, the slide member engaging the first snare carrier.

10. The strainer of claim 9, further comprising a butt-side component including a second bracket member constructed and arranged to be releasably mounted to the snare drum, the second bracket member including an adjustment member mounted for movement with respect to a fixed base plate, and a second slide member fixed to the adjustment member, the second slide member engaging the second snare carrier.

11. The strainer of claim 10, wherein the second snare carrier includes tension adjustment structure associated with each snare for individually adjusting tension of each snare.

12. The strainer of claim 11, wherein the tension adjustment structure includes a screw associated with each snare.

13. The strainer of claim 10, further comprising an adjustment knob associated with the adjustment member, such that movement of the adjustment knob adjusts a position of the second adjustment member and the second snare carrier in a direction generally transverse with respect to a longitudinal direction of the snares.

14. The strainer of claim 10, wherein the second slide member includes walls defining a receptacle receiving the second snare carrier, at least one of the walls including at least one groove in a proximal end thererof, and wherein the second snare carrier includes a casing having at least one post extending therefrom, with the at least one post engaging the at least one groove such that the second snare carrier can only be inserted into the receptacle in a single direction to ensure a correct orientation of the snare assembly.

15. A strainer for a snare drum having a bottom drumhead, the strainer comprising:

a snare assembly including first and second snare carriers and a plurality of snares coupled with each snare carrier and extending between the snare carriers, a throw-side component including a first bracket member constructed and arranged to be releasably mounted to the snare drum, and a first slide member manually linearly moveable relative to the bracket member and engaging the first snare carrier, and a butt-side component including a second bracket member constructed and arranged to be releasably mounted to the snare drum opposite the first bracket member, the second bracket member including a second slide member engaging the second snare carrier, wherein the first slide member includes at least one slider handle fixed thereto so that the at least one handle moves linearly together with the first slide member, and a locking toggle such that when the strainer is coupled to the snare drum with the snares generally adjacent to the bottom drumhead, movement of the first slide member via manual linear movement of the at least one slider handle causes the snares to move toward the bottom drumhead, with the locking toggle being constructed and arranged to be 1) moved to a first, locking position engaging the first bracket member so as to prevent the first slide member from moving further thus, locking the first slide member to the first bracket member, and 2) moved to a second, release position releasing the first slide member from engagement with the first bracket member.

16. The strainer of claim 15, wherein the first slide member includes a first adjustment knob associated with the first snare carrier so that movement of the first adjustment knob adjusts a position of the first snare carrier in a first, snare tensioning direction.

17. The strainer of claim 16, wherein the first bracket member includes a first adjustment member mounted for movement with respect to a fixed first base plate, and further comprising a second adjustment knob associated with the first adjustment member, such that when the first slide member is locked to the first bracket member, movement of the second adjustment knob adjusts a position of the first adjustment member and thus the first snare carrier in a second direction transverse to the first direction.

18. The strainer of claim 17, wherein the second bracket member includes a second adjustment member mounted for movement with respect to a fixed second base plate, the second slide member being fixed to the second adjustment member, and further comprising a third adjustment knob associated with the second adjustment member such that movement of the third adjustment knob adjusts a position of the second adjustment member and the second snare carrier in the second direction.

19. The strainer of claim 16, wherein the second snare carrier includes tension adjustment structure associated with each snare for individually adjusting tension of each snare.

20. The strainer of claim 15, wherein the second slide member includes walls defining a receptacle receiving the second snare carrier, at least one of the walls including at least one groove in a proximal end thererof, and wherein the second snare carrier includes a casing having at least one post extending therefrom, with the at least one post engaging the at least one groove such that the second snare carrier can only be inserted into the receptacle in a single direction to ensure a correct orientation of the snare assembly.

21. The strainer of claim 15, in combination with the drum, wherein each of the first bracket member and the second bracket member is coupled to at least one tension rod of the drum so that the first and second bracket members are in opposing relation, with the snares disposed generally adjacent to the bottom drumhead.

* * * * *